United States Patent [19]

Mann

[11] 4,372,153

[45] Feb. 8, 1983

[54] PIPE CLAMP AND A PROBING DEVICE COMPRISING A PIPE CLAMP

[75] Inventor: Adriaan B. Mann, Delft, Netherlands

[73] Assignee: Goudsche Machinefabriek B.V., Gouda, Netherlands

[21] Appl. No.: 220,051

[22] PCT Filed: Apr. 3, 1980

[86] PCT No.: PCT/NL80/00010

§ 371 Date: Dec. 3, 1980

§ 102(e) Date: Dec. 2, 1980

[87] PCT Pub. No.: WO80/02174

PCT Pub. Date: Oct. 16, 1980

[30] Foreign Application Priority Data

Apr. 3, 1979 [NL] Netherlands ..... 7902608

[51] Int. Cl.[3] ..... G01N 3/02

[52] U.S. Cl. ..... 73/84; 73/859; 279/1 F

[58] Field of Search ..... 73/84, 859; 279/28, 279/1 F, 1 DA, 50

[56] References Cited

U.S. PATENT DOCUMENTS 3,998,428 12/1976 Miles ..... 254/29 R

FOREIGN PATENT DOCUMENTS 429314 10/1974 U.S.S.R. ..... 73/84

654794 3/1979 U.S.S.R. ..... 279/28

*Primary Examiner*—Jerry W. Myracle

[57] ABSTRACT

A pipe clamp suitable for transmitting a tensile force as well as a compression force to a pipe comprises a housing (18) having a cylindrical inner wall, an opening (19) for passing a pipe to be clamped, two guide blocks (21,22) each having a sliding surface (32,33) running obliquely with respect to the axis of the opening (19), and two clamping blocks (34,35) which may cooperate with the oblique sliding surface of the respective guide block. The axis of the cylindrical inner wall of the housing (18) and of the opening (19) are substantially perpendicular with respect to each other and the guide blocks (21,22) may be rotated over 180°. By rotating the guide blocks the pipe clamp can be switched from the pulling condition to pressing and vice versa.

8 Claims, 4 Drawing Figures

PIPE CLAMP AND A PROBING DEVICE COMPRISING A PIPE CLAMP

The invention relates to a pipe clamp by means of which a tensile force or a compressive force may be transmitted to a pipe or a string of pipes and to a probing device including the pipe clamp. A pipe clamp of this type might be used for instance in a probing device for forcing a cone connected to the lower end of a string of probing pipes by means of a coupling member (and optionally an additional friction-sleeve) into the ground. The cone may be loaded separately by means of an internal bar. In case of an additional friction sleeve between the cone and the coupling member the combination of friction sleeve and cone may be also be loaded after slidingly extending the cone. Based on the hydraulic pressure measured by means of a pressure gauge, the cone resistance, the local adhesive hold and the total adhesive hold may be determined. These values may be used for calculating foundations. Based on the correlation between the cone resistance and the local adhesive hold the kind of soil may be determined. The pressure gauge reading is rather inaccurate. This implies that upon calculating the load capacity of a foundation pillar or a bed plate, the settling of a foundation and the like a large safety factor has to be introduced; the foundation will have to be relatively heavy.

More accurate measurements may be made by replacing the hydraulic measurement by means of a pressure gauge, by an electric measurement using strain strips or an inductive measuring system. Between the measuring system and the recording apparatus there will be a cable running through a slot of an auxiliary member or a gland loaded by a press cylinder acting thereon at the location of the upper end of the uppermost pipe. This construction has the drawback that said auxiliary member or gland provided with a slot will rest on the upper end of the string of pipes so that it will be impossible to extend the pipe string by screwing thereto the next pipe section when driving the pipe string into the ground over a distance corresponding to one pipe section.

The object of the invention is to provide a pipe clamp of the above mentioned type suitable for use among others in a probing device, which clamp may be clamped about a pipe to be loaded and which enables a compressive loading as well as a tensile loading of a pipe.

According to the invention the pipe clamp comprises a housing having a cylindrical inner wall and an opening for passing a pipe to be clamped, in which the axes of the cylindrical inner wall and the opening for passing the pipes are substantially perpendicular with respect to each other, two guide blocks rotatably over at least 180° mounted within said housing, each having a sliding or abutment surface running obliquely with respect to the axis of the opening for passing the pipes, and two clamping blocks each being capable of cooperating with an oblique sliding or abutment surface of a guide block.

When using the pipe clamp in a probing device it is possible to screw the next pipe onto a string of pipes when driving the string into the ground and to unscrew the uppermost pipe of a string when extracting the string from the ground. When reverting from driving to extracting and vice versa the guide blocks with the clamping blocks only have to be rotated over 180°. An electrical measuring cable that may optionally be used may run sidewise from a location not interfering with the screwing and unscrewing of a pipe section. The pipe clamp according to the invention is not limited to the use in a probing device.

A firm clamping of a pipe which does not have to possess any groove is obtained if each one of the clamping blocks is slidable along an oblique sliding surface of a guide block.

In another embodiment the clamping blocks may be provided with an axle for rotation and may have a face capable of cooperating with the abutment surface of a guide block as well as an adjoining roller face, all mounted in such a manner that the clamping blocks may be tilted over on the abutment surface in one direction only.

The latter construction is particularly suitable for catching within a groove of a pipe.

For operatively clamping on a relatively large surface area of a pipe the clamping blocks will possess an inwardly concave clamping surface.

The tilting of the clamping blocks to an undesired position may be prevented and a good guiding may be assured if each of the clamping blocks is connected to a guide block by means of a keyway slidably mounted within a groove of a guide block.

Usually it will be necessary that each one of the guide blocks is forced inwardly by a spring.

For enabling an easy rotation of the guide blocks with the clamping blocks it is preferred that each one of the guide blocks is connected to an operating means running through a cover of the housing.

In case the clamping blocks may be tilted these clamping blocks will preferably be loaded in the clamping position by means of a spring.

The invention also relates to a probing device comprising a pipe clamp described above.

The compressive or tensile loading of the pipe string along the axis thereof without interference of the screwing or unscrewing of a pipe section by the hydraulic apparatus may very easily be performed if the pipe clamp is connected to a lower bridge member which by means of at least two push-pull rods is connected to an upper bridge member, which upper bridge member may be moved up and down by means of at least two hydraulic cylinders.

The compressive as well as tensile loading of a pipe string by means of the lower bridge member in which the pipe clamp may easily be mounted and released, is possible if, between a box having an external thread welded onto the housing of the pipe clamp and the wall having a stepped shoulder of a central opening in the lower bridge member, there is provided a nut having a complementary shoulder, which nut is screwed onto the thread of the box.

The invention will now be described in detail with reference to the diagrammatical figures representing two embodiments of the invention.

FIG. 1 diagrammatically shows part of a hydraulic system of a probing device including a pipe clamp according to the invention.

Figure 1:
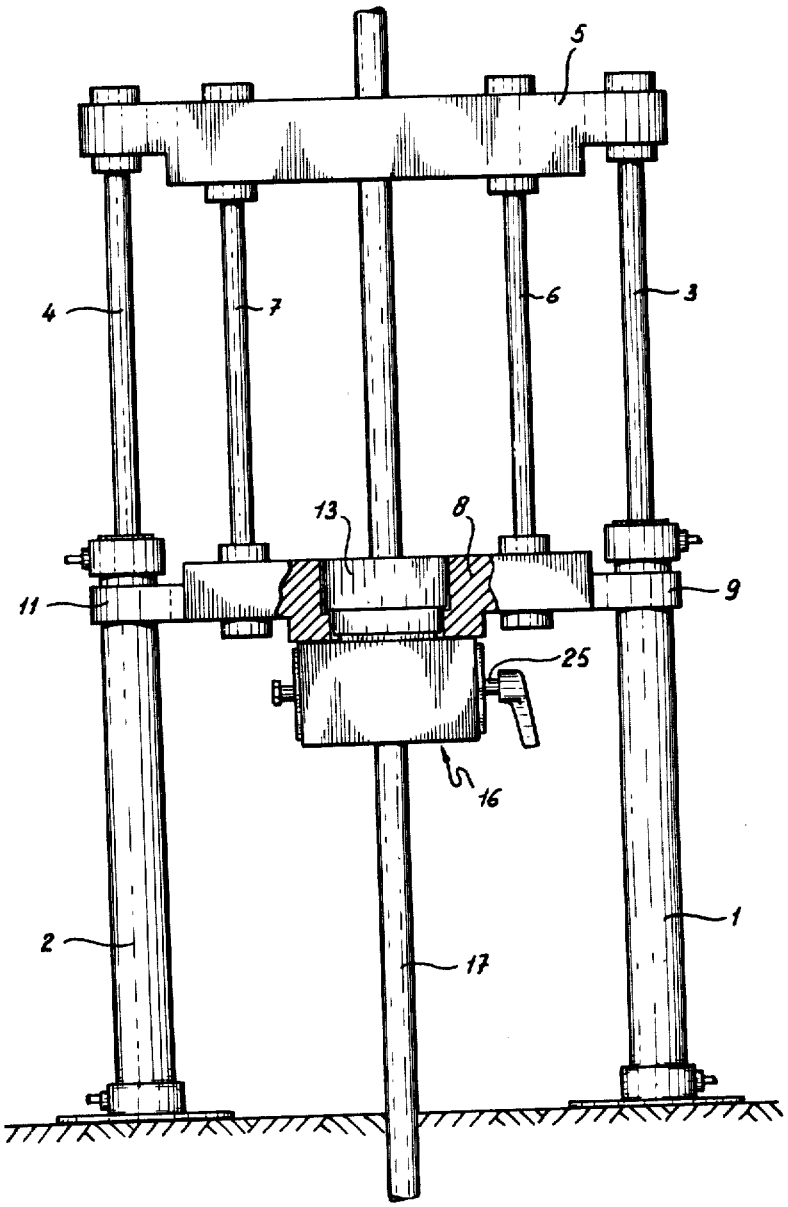

With reference to FIG. 1 there has been shown part of a probing device including two double acting hydraulic cylinders 1 and 2. The upper ends of piston rods 3 and 4, respectively, of these cylinders have been fastened to an upper bridge member 5 which in its turn has been connected to a lower bridge member 8 by means of a number of push-pull rods 6, 7. The lower bridge member is guided by guide straps 9, 11 about the cylinders 1, 2.

In the center of the lower bridge member 8 there has been provided an opening having a stepped shoulder 12. Within this opening there has been provided a nut 13, which has been screwed onto a box 14. The nut 13 possesses a stepped shoulder 15 cooperating with the shoulder 12.

At the lower end thereof the box 14 has been welded to a pipe clamp 16 constructed in accordance with the invention and intended to be clamped on a pipe of a pipe string 17 and to enable compressive and tensile loading of this string.

The pipe clamp 16 comprises a housing 18 having a cylindrical inner wall the axis of which is perpendicular with respect to the axis of the pipe string 17. This pipe string passes through an opening 19 of the housing 18. Within the housing 18 there have been provided two guide blocks 21, 22. These guide blocks may slide in the longitudinal direction and may furthermore be rotated by an operating means 25, 26 running through a cover 23, 24 respectively. The guide blocks 21, 22 are forced inwardly by means of springs 27, 28 respectively.

Within the inner surfaces of the guide blocks facing each other there has been provided a groove 29, 31 having a sliding surface 32, 33 running obliquely with respect to the axis of the pipe string 17.

Within these grooves a clamping block 34, 35 respectively may slide along oblique sliding surfaces 32, 33 respectively.

Each one of the clamping blocks possesses a toothed concave clamping surface 36 facing inwardly.

In order to prevent a tilting and the like of the clamping blocks within the housing 18 the clamping blocks have been connected to the side walls of groove 29, 31 by means of a key way 37.

Figure 2:
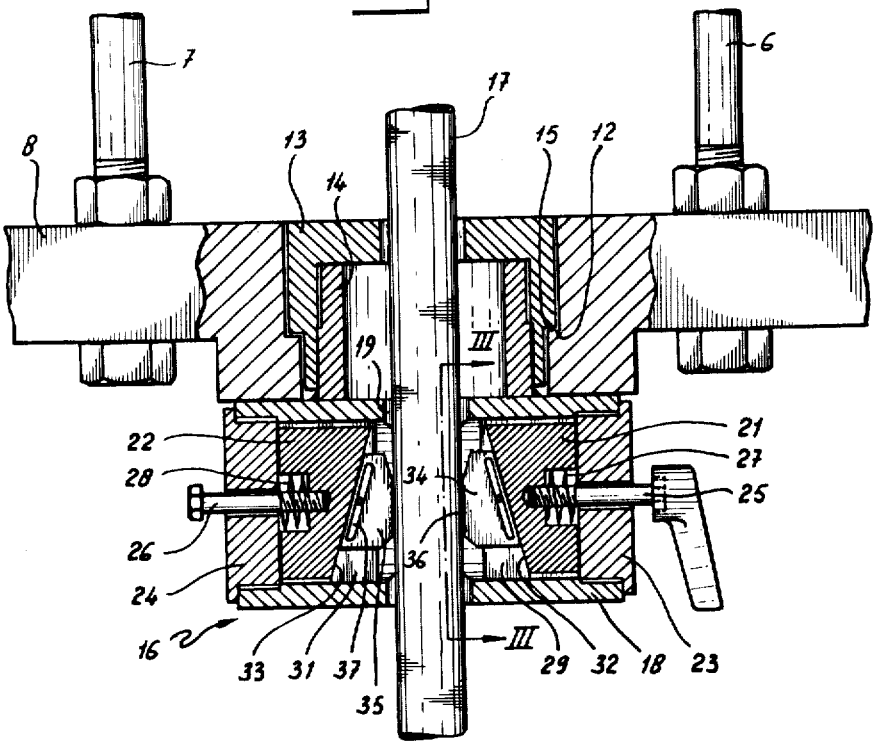
FIG. 2 represents a vertical cross section of a pipe clamp and part of the probing device on a larger scale.

In the position of the guide blocks 21, 22 represented in FIG. 2 the pipe string 17 may be driven into the ground when the bridge members 5 and 8 are moved downward by means of the hydraulic cylinders 1, 2. Due to the inertia of the pipes 17 the clamping blocks will be pushed upward along the sliding surfaces 32, 33 and will be clamped gradually more firmly.

In case a pipe string has to be extracted from the ground the clamping blocks 34, 35 will be released from the uppermost pipe by moving the bridge members 5, 8 upward whereupon the guide blocks 21, 22 will be rotated over 180° by means of the operating means 25, 26. The sliding surfaces 32, 33 will then converge downwardly with respect to each other. In an intermediate angular position (about 90°) the clamping blocks do not clamp so that the pipe string 17 may be passed upward and downward.

It will be clear that upon driving into the ground the centrally extending lower edge of the lower bridge member 8 will push against the upper surface of the housing 18 whereas upon extraction from the ground the shoulder 12 of the lower bridge member 8 pushes upward against the shoulder 15 of the nut 13.

Where the cylinders 1, 2 and the push-pull rods 6, 7 are located at a lateral distance from the pipe string an optionally present electric cable may easily be diverted from the uppermost pipe of the string 17 to a recording apparatus for connecting measuring devices such as strain strips or an induction coil at and close to the cone at the lower end of the string 17 to the recording apparatus.

When driving a pipe into the ground a next pipe may be screwed onto the string 17. When extracting a pipe from the ground the uppermost pipe of the string 17 may be unscrewed. In both cases this will lead to a considerable saving of time.

Each one of the operating means 25, 26 may carry an indication signifying the driving position and the extracting position.

Each one of the pipes of the string 17 may be provided with a slight groove in which the clamping surface 36 of the clamping blocks 34, 35 may catch. In this way any slippage may be prevented with great certainty.

Figure 3:
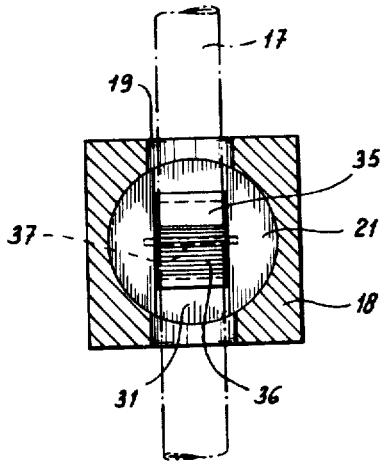
FIG. 3 represents a cross section along the line III—III in FIG. 2.
Figure 4:
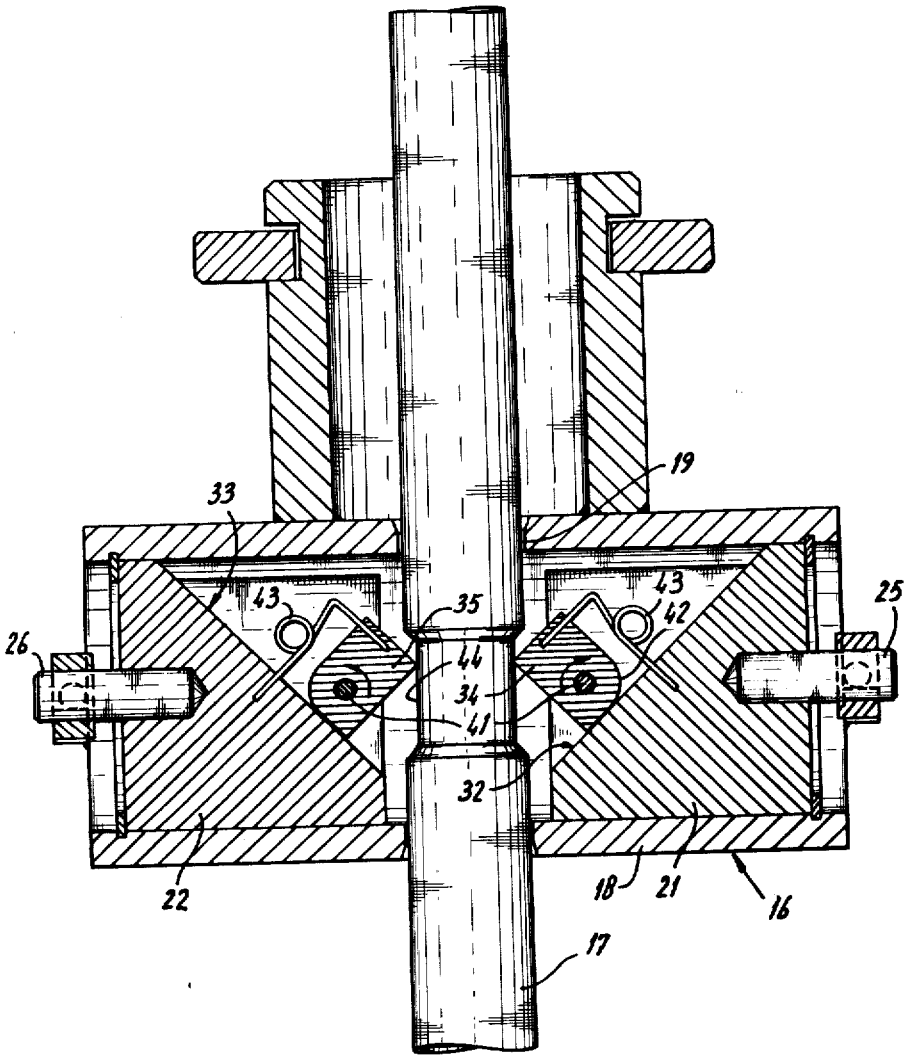
FIG. 4 represents a cross section of a variation of a pipe clamp according to the invention comparable with the one shown in FIG. 2.

In the embodiment of FIG. 4 the corresponding parts have been indicated with the same reference numerals as in FIGS. 1 to 3. The clamping blocks 34, 35 of this embodiment consist of parts rotatable about an axle 41 said parts having a face cooperating with an abutment surface 32, 33 of a guide block 21, 22 respectively and an adjoining roller face 42.

Starting from the represented clamping position each one of the clamping blocks 34, 35 may only rotate in the direction of the arrow, such only being feasible when pulling the pipes 17 upward. Accordingly the represented position is a position in which the pipes may be driven into the ground. In the clamping position the clamping blocks are loaded against movement into the direction of the arrow by means of a spring 43.

Also in this instance the guide blocks 21, 22 may be rotated over 180° by means of the operating means 25, 26 in order to revert from a driving position into an extracting position.

This embodiment is particularly suitable for driving and extracting pipes having a groove 44, into and from the ground, respectively. The parts of the clamping blocks 34, 35 extending inwardly may catch on the shoulder at the location of the transition from the groove 44 to the normal pipe diameter.

Within the scope of the claims several modifications are possible.

I claim:

1. A pipe clamp comprising: a housing having a cylindrical inner wall and an opening for passing therethrough a pipe to be clamped, two guide blocks accommodated within said housing and each having a sliding surface running obliquely with respect to the axis of said opening, and two clamping blocks respectively capable of cooperating with the oblique sliding surfaces of said guide blocks, the axes of the cylindrical inner wall of the housing and of the opening being substantially perpendicular with respect to each other, and said two guide blocks being rotatable over 180° within said housing.

2. The pipe clamp of claim 1, wherein the clamping blocks are each provided with an axle for rotation and each have a face capable of cooperating with the respective sliding surface of the guide block, and an adjoining roller face, all mounted in such a manner that the clamping blocks may be tilted on the sliding surfaces in one direction only.

3. The pipe clamp of claim 2, wherein said rotatable clamping blocks are loaded in the clamping position by means of springs.

4. The pipe clamp of claim 1, wherein the clamping blocks are respectively connected to the guide blocks by means of keyways and are respectively slidably mounted within grooves of the guide blocks.

5. The pipe clamp of claim 1 or 3, wherein each one of the guide blocks is forced inwardly by a spring.

6. The pipe clamp of claim 1, wherein each one of the guide blocks is connected to an operating means running through a cover of the housing.

7. A probing device comprising: a pipe clamp connected to a lower bridge member which by means of at least two pushpull rods is connected to an upper bridge member which may be moved up and down by means of at least two hydraulic cylinders, the pipe clamp comprising a housing having a cylindrical inner wall and an opening for passing a pipe to be clamped, two guide blocks accommodated within said housing and each having a sliding surface running obliquely with respect to the axis of said opening, and two clamping blocks respectively capable of cooperating with the oblique sliding surfaces of said guide blocks, the axis of the cylindrical inner wall of the housing and of the opening being substantially perpendicular with respect to each other, said two guide blocks being rotatable over 180° within said housing.

8. The probing device of claim 7, wherein a box is fixed onto the housing and the lower bridge member has a wall having a stepped shoulder in a central opening, and a nut having a complementary shoulder being provided between said box and said wall, said nut being fastened to said box.

* * * * *